United States Patent [19]

Oudet

[11] Patent Number: 4,707,677

[45] Date of Patent: Nov. 17, 1987

[54] MULTIPOLAR MAGNETIZATION DEVICE

[75] Inventor: Claude Oudet, Besançon, France

[73] Assignee: Portescap, La Chaux-de-Fonds, Switzerland

[21] Appl. No.: 811,837

[22] PCT Filed: Mar. 29, 1985

[86] PCT No.: PCT/CH85/00051

§ 371 Date: Nov. 29, 1985

§ 102(e) Date: Nov. 29, 1985

[87] PCT Pub. No.: WO85/04512

PCT Pub. Date: Oct. 10, 1985

[30] Foreign Application Priority Data

Apr. 2, 1984 [CH] Switzerland ..... 1673/84
Feb. 21, 1985 [CH] Switzerland ..... 794/85

[51] Int. Cl.[4] ..... H01F 7/20
[52] U.S. Cl. ..... 335/284; 310/90.5
[58] Field of Search ..... 335/284, 234; 118/621; 310/90.5; 361/142-144

[56] References Cited

U.S. PATENT DOCUMENTS 4,330,727 5/1982 Oudet ..... 310/268

*Primary Examiner*—A. T. Grimley
*Assistant Examiner*—Jane K. Lau
*Attorney, Agent, or Firm*—Cushman, Darby & Cushman

[57] ABSTRACT

In order to form, on opposite plane surfaces of a magnetizable plate portion of a part (62), a series of magnetized areas, the device comprises a frame (68) wherein two support parts (64, 65) made of a material having a high magnetic permeability presenting respectively plane polar surfaces are arranged in parallel facing each other and are coupled with portions of electric conductors arranged so as to generate between the polar surfaces of the opposite support parts magnetic field producing the magnetization of said areas. One of the support parts (65) is displaceable with respect to the other one (64) and with respect to the frame (68), perpendicularly to the polar surfaces so as to bring close and to spread apart said polar surfaces with respect to the flat portion of the parts to be magnetized.

7 Claims, 5 Drawing Figures

MULTIPOLAR MAGNETIZATION DEVICE

The present invention concerns a multipolar magnetization device for forming on the opposite plane surfaces of a flat magnetizable part of a piece, a series of magnetized zones, this device comprising a frame in which several elongated portions of electric conductors are disposed so as to create magnetic fields producing the magnetization of said zones.

The pieces to magnetize are, for example, thin disk-shaped rotor parts for electric motors such as described, for example in the Swiss patent No. 637 508. These disks are generally realized in a material with a very high coercive field such as samarium-cobalt, and must have a relatively high number of magnetized zones of alternating polarities.

The invention is aimed at providing a device of the type mentioned at the beginning, which permits a high magnetization field well delimited in each zone to magnetize to be reached, and provides pratically the same absolute value of the magnetization field for each zone, the number of which can be quite high.

For this purpose, the device according to the invention is characterized in that it comprises in said frame two support parts of a material of a high magnetic permeability having respectively substantially plane polar surfaces disposed to be parallel and facing each other, at least one of these support parts being coupled magnetically with a set of said portions of electric conductors disposed so as to generate between the polar surfaces of the support parts disposed facing each other, said magnetic fields producing the magnetization of said zones, and at least one of the support parts being displaceable in relation to the other and in relation to the frame perpendicularly to the polar surfaces, so as to permit the polar surface of the flat part of the piece to magnetize to be brought together and moved apart.

In this magnetization device, it is generally difficult on the one hand, to separate the two support parts once the magnetization terminated, and on the other hand, to remove the magnetized piece from the support parts. It is to be noted in this respect, that the pieces to magnetize are extremely fragile because of the nature of the material used, and because of their generally small thickness.

Thus, the invention is equally aimed at providing a magnetization device arranged in a simple and efficient way to facilitate the removal of the magnetized pieces and to permit the magnetization of such pieces in series at a fast rate without a significant loss of magnetized pieces.

Figure 1:
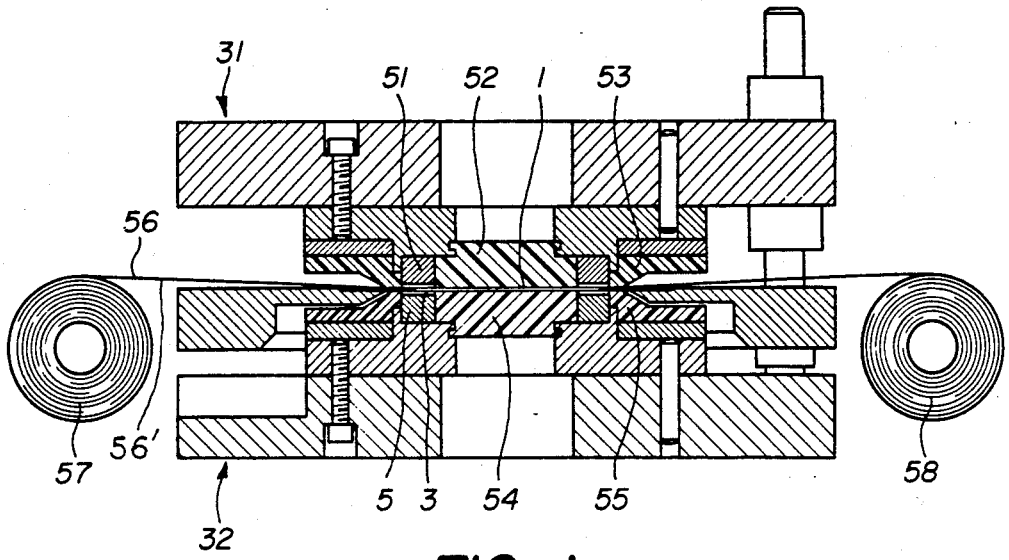
Figure 2:
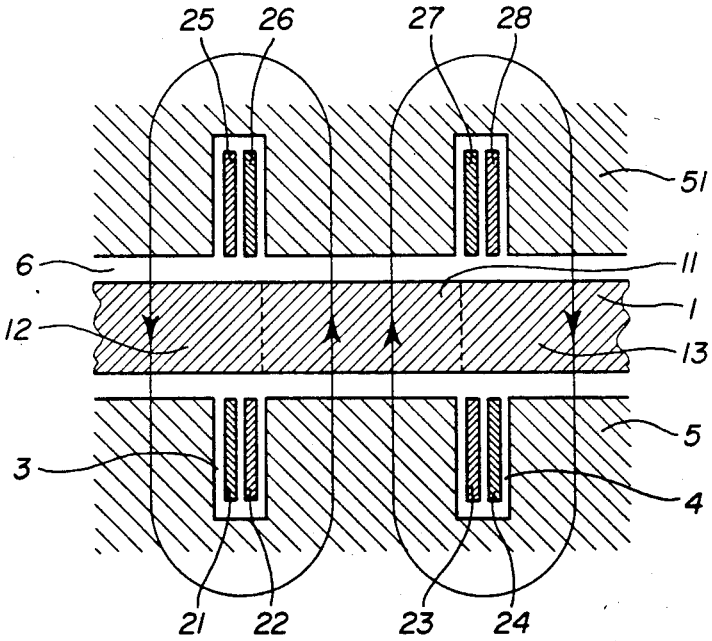
Figure 3:
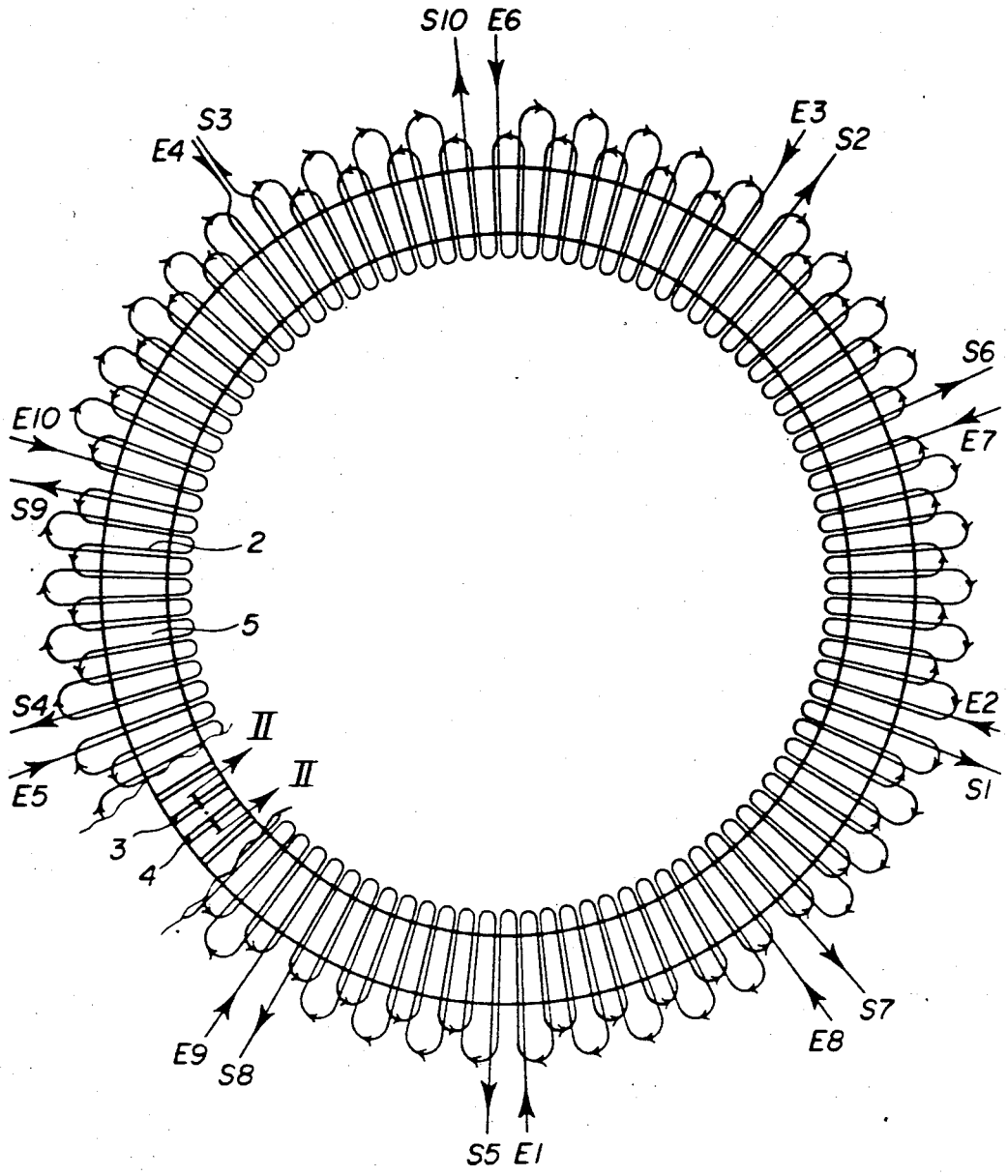
Figure 5:
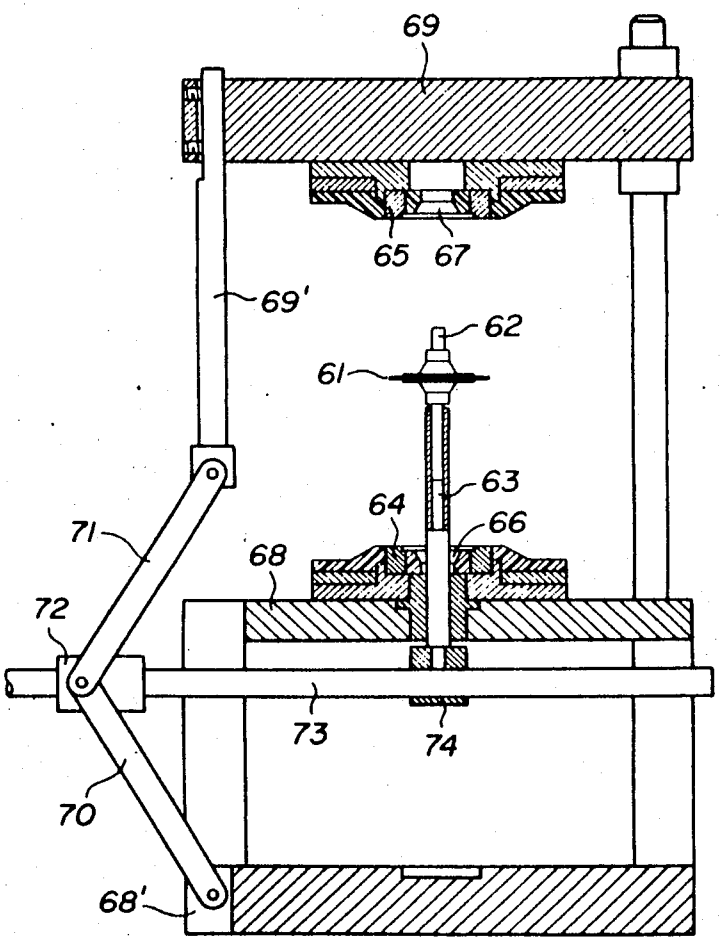
Figure 4:
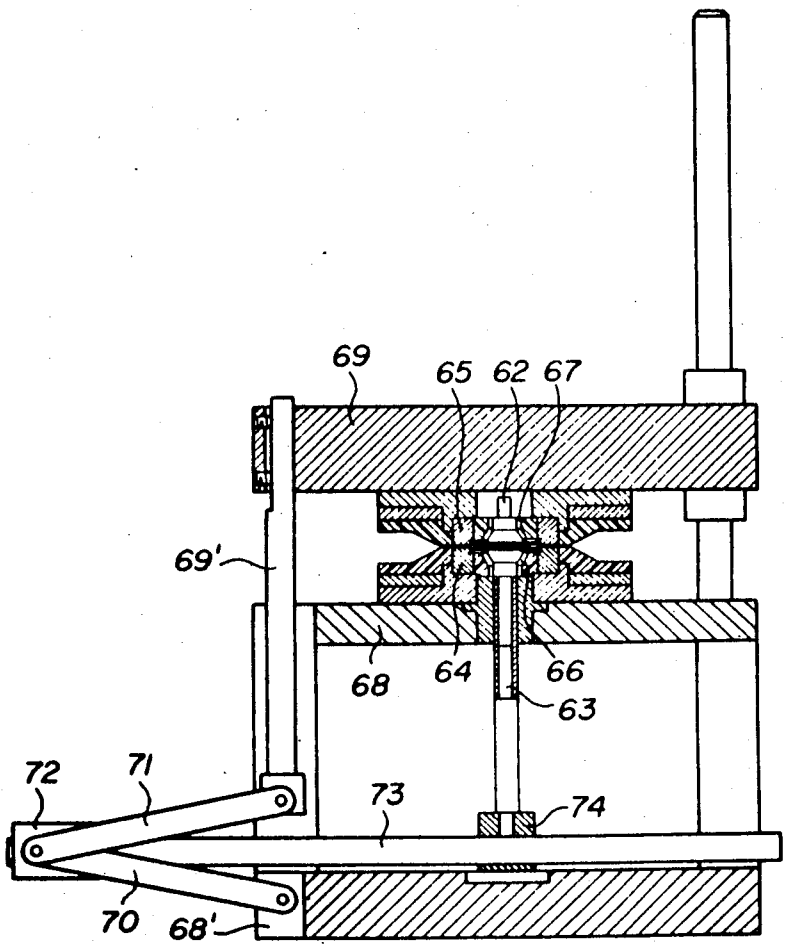

The invention will be better understood by reading the description of exemplary realizations given hereunder, illustrated in the appended drawing, in which:

FIG. 1 shows, in axial section, a first embodiment of a magnetizing device according to the invention, FIG. 2 is a schematic transverse cross-section along the line II—II of FIG. 3 illustrating the magnetization of a zone of the body to magnetize, FIG. 3 is a diagram of the disposition and of the power supply of the electric conductors in the magnetization device, FIG. 4 shows, in axial section, a second embodiment of a magnetization device according to the invention in its closed position, and, FIG. 5 shows the device of FIG. 4 in the open position.

The magnetization device according to FIG. 1 comprises two annular support parts 5, 51 of a highly permeable material such as an iron-cobalt alloy, between which is placed a disk to magnetize 1 of an annular flat shape, of a small thickness in relation to its diameter, and realized, for example, in samarium-cobalt. The support parts 5, 51 have facing the disk 1 respective plane polar surfaces, and comprise each a series of radial slots such as 3, in which are housed portions of electric conductors, not represented in this figure. These conductors are arranged and connected to electric current sources in the way described hereunder with reference to FIGS. 2 and 3.

More particularly, the device of FIG. 1 is intended for the magnetization of a multipolar rotor of a stepping motor which has the shape of the annular disk 1, partly visible in section in FIG. 2. Elongated portions of conductors such as 21 to 28, designated generally by 2 in FIG. 3, are disposed so as to be parallel to the disk in the radial direction thereof, and to produce in the circumferential direction of the disk a series of magnetized zones in the transverse direction, i.e. in the axial direction of the disk. The portions of conductors are placed in slots such as the slots 3 and 4 of the support parts 5, 51, visible in FIG. 2. FIG. 3 shows in plan the support part 5, the outer and inner edges of its annular surface defining the magnetized surface on the rotor disk. As it will become apparent from the following description, this surface consists of a series of elongated zones, radially oriented, and having alternating polarities on each face of the disk.

The section along the line II—II of FIG. 3 is shown in FIG. 2. Each of the adjoining slots 3, 4 comprises a pair of portions of conductors, respectively 21, 22 and 23, 24. A similar arrangement of the support part 51 and of the portions of conductors 25, 26 and 27, 28 is placed facing the first one, so as to form an air gap 6, in which the disk to magnetize 1 is disposed. The ends of the radial portions of conductors are connected as indicates FIG. 3, to form groups of series connected portions of conductors, the ends of each of these groups being connected to the terminals of a respective pulse generating device,not represented. In FIG. 3, the ends of the different groups associated with the part 5 have been designated respectively by $E_1$, $S_1$; $E_2$, $S_2$; $E_3$, $S_3$; . . . ; $E_{10}$, $S_{10}$. Each group comprises twenty portions of conductors, and the support has a total of one hundred slots such as 3 or 4. The different groups are shifted one relatively to the other, so that portions of conductors belonging to two different groups are housed in each slot, these portions being connected in such a way that the magnetization current flows through them in the same direction. In the example of FIG. 3, the groups overlap on one half of their angular length. The conductors of the opposite part 51 are arranged in a similar way, an additional shift, for example of one fourth of their angular length, being preferably provided between the respective groups of the two support parts disposed facing each other.

On the other hand, the different pulse generating devices are arranged to provide current pulses of the same amplitude and of the same duration. They comprise essentially, for example, a capacitor, a load resistor mounted in series, and a switch system arranged to connect the capacitor for a determined duration to the terminals of the corresponding group of portions of conductors. The capacitor is preferably charged from a power source common to the totality of the pulse generating devices.

Consequently, in the diagram of FIG. 2, in each pair of portions of conductors, a current originating from two different pulse generators flows in the same direction. Each portion of conductor of a pair is connected in series with a portion of conductor housed in the adjoining slot of the same support part in such a way that the currents flowing through the portions of conductors housed in adjoining slots are in opposite directions. On the other hand, the currents flowing through pairs of portions of conductors housed in slots disposed facing each other are oriented in the same direction. Thus, the magnetic field created by four pairs of portions of conductors such as shown in FIG. 2 has, for example, the direction indicated in this figure by the arrows, and consequently, the magnetization of a zone 11 of the disk 1 delimited by dotted lines is realized in the direction transverse to the disk, bringing about the apparition of poles of opposite names on each of the surfaces thereof. It appears equally from FIG. 2, that the zones adjoining the zone 11 on each side thereof, i. e. the zones 12 and 13, partly visible, are magnetized in a parallel but opposite direction to that of the magnetization of the zone 11.

The arrangement according to FIG. 3 offers the advantage that the outer connections between the different portions of conductors are realized in such a way that a closed loop is formed around each zone to magnetize, and is parallel to the corresponding surface of the disk to magnetize. This permits a particularly efficient use of the magnetization current. To obtain these closed loops in the represented example, the groups of portions of conductors which overlap are oriented in opposite directions in relation to their connections to the respective pulse generating devices. Thus for example in the group $E_6$, $S_6$, the current flows along the periphery clockwise, while in the groups $E_2$, $S_2$ and $E_3$, $S_s$ which cooperate with this group $E_6$, $S_6$, the current flows along the periphery in the opposite direction. The connections to the pulse generating devices are only represented schematically in FIG. 3, but it is obvious that in this case, the loop can also be easily closed by an appropiate configuration of the conductors, such as shown, for example, at the connections $S_3$, $E_4$.

According to the axial section of FIG. 1, the support parts 5, 51 are embedded in a plastic material forming respectively the parts 52, 53 and 54, 55. Each of the support parts is integral with a respective assembly 31, 32, the assembly 31 being displaceable in the axial direction of disk 1 in relation to the assembly 32, integral with the frame of the apparatus.

To facilitate, or even to permit the separation of the two support parts once the magnetization of the disk terminated, separation sheet 56, and a second separate sheet 56' of an electrically insulating and non-magnetic material are disposed, on each side of the disk to magnetize between the latter and the two support parts. The thicknesses of these sheets, or of the layers of sheets should such layers be used, disposed respectively on each side of the piece to magnetize are different from each other, and further, are very small in comparison with the thickness of the disk to magnetize. The material used for these sheets preferably is "mylar", a flexible, practically non-extensile material.

The asymmetry which results from the different thicknesses of the separation sheets or layers placed between the piece to magnetize and the two support parts permits the latter to be moved apart relatively easily by an axial relative displacement, then a displacement of the sheets 56, 56' in a direction parallel to the polar surfaces of the support parts permits the magnetized disk to be released from the polar surfaces. In practice, it suffices to displace the thinner sheet on which the magnet remains stuck. Appropriate means for pulling the sheets 56, 56' in the desired direction are shown in FIG. 1 in the form of a roll 58, which can be operated by hand to move forwards by a given length the two separation sheets together, which in this example are realized in the form of bands. These bands are fed from a reserve roll 57 on which the two bands are rolled up together, the rolls 57 and 58 being mounted each on one side of the actual magnetization device.

FIGS. 4 and 5 show another embodiment of the device, utilizable for magnetizing pieces provided with parts protruding from the plane of the plane surfaces of the piece to magnetize. In the case of the example illustrated, the part to magnetize has the shape of an annular disk 61 mounted by means of a fixation piece on a shaft 62. This whole piece is placed on a supporting device comprising a hollow element 63.

The two support parts are designated in this example by 64 and 65, and each have a respective hollow, 66, 67, permitting the protruding part of the fixation piece and the end of the shaft with its supporting device to be introduced inside the support parts, so that the flat part to magnetize can come into contact with the polar surfaces of the support parts 64, 65.

The support part 64 is mounted on the frame 68 of the magnetization device, while the support part 65 is integral with a part 69, displaceable vertically in relation to this frame.

An actuating device for the displacement of the supporting device and of the support part 65 in relation to the support part 64 comprises two arms 70, 71 articulated at one of their ends on an articulation piece 72, the second ends of these arms being articulated round axes parallel to the articulation axes of said first ends, respectively on a part 68' of the support 68, and on a linking rod 69' integral with the part 69.

The articulation piece 72 slides on an actuating rod 73 disposed horizontally, this rod 73 being held horizontally, or if desired slidably guided in a coupling piece 74 integral with the supporting device 63. The frame is arranged so as to permit the passage of the rod 73 and a vertical displacement of the latter by the effect of the actuating device.

The lengths of the arms 70 and 71 between their points of articulation are choosen equal, so that the actuating rod 73 moves in a symmetrical manner in relation to the point of articulation of the arms on the parts 68' and 69'. The vertical displacement of this rod 73 is transmitted to the supporting element 63, and the height of the latter is chosen in such a way that the part 61 of the piece to magnetize is disposed symmetrically in relation to the polar surfaces of the support parts 64 and 65. The device described ensures that this symmetry is maintained in all the relative positions of the two support parts, the extreme positions being, on the one hand, that illustrated in FIG. 4 which is the closed position of the device for the magnetization process, and on the other hand, an open position of the device as it is illustrated in FIG. 5, thus permitting the piece to magnetize to be placed in position and removed.

From the closed position of the device in which the plane surfaces of the magnetized part and the plane polar surfaces of the support parts 64 and 65 are in contact, the separation of the surfaces in contact is brought about in a perfectly symmetrical way by the effect of the actuating device, which is practically a necessary condition for permitting the opening of the magnetization device.

It is understood that the example described with reference to FIGS. 4 and 5 constitutes only one possible embodiment of a device for achieving the necessary symmetry. The invention can also be embodied by other structures, which are accessible to the person skilled in the art.

I claim:

1. A multipolar magnetization device for forming on opposite plane surfaces of a flat magnetizable portion of a body a series of magnetized zones, comprising: a frame; two support parts mounted on said frame, said support parts being made of a material of high magnetic permeability and having substantially plane polar surfaces, respective plane polar surfaces of said support parts being arranged in spaced relation parallel to and facing each other, at least one of said support parts being coupled magnetically with a set of elongated portions of electric conductors so as to generate a series of magnetic fields between said plane polar surfaces of said support parts facing each other; and means for displacing at least one of said support parts in relation to the other and in relation to said frame in a direction perpendicular to said plane surfaces of said support parts, so as to permit said plane polar surfaces to be moved relative to each other towards or away from opposite plane surfaces of a flat body portion to be magnetized when such body portion is disposed between said plane polar surfaces of said support parts.

2. A device according to claim 1 wherein separation sheets of a non-magnetic electrically insulating material of a thickness significantly smaller than that of the flat body portion to be magnetized, are disposed on either side of the flat body portion, between the same and the plane polar surfaces of the support parts, the respective thicknesses of the separation sheets disposed on each side of the flat body portion being different from each other.

3. A device according to claim 1 to be used for bodies which comprise at least one protruding portion within the perimeter of the flat portion to be magnetized, wherein said support parts have at least one hollow for receiving the protruding portion and allowing the plane surfaces of the flat body portion to come into contact with the plane polar surfaces of the support parts, the magnetization device further comprising supporting means for the body which means are movable in relation to said support parts through an opening in one of them, and comprising an actuating device coupled with at least one of said support parts and with said supporting means to effect relative displacement between said one support part and said body supporting means such that said plane polar surfaces of said support parts remain perfectly symmetrical during such displacement in relation to a plane of symmetry of the flat body portion extending parallel to the plane surfaces thereof.

4. A device according to claim 3 wherein said support parts comprise a first support part mounted in a fixed position in relation to the frame, a second support part and wherein said supporting means is slidably mounted in relation to said first support part.

5. A device according to claim 2 wherein said actuating means comprise at least a first and a second arm, each of said arms being articulated at a first end thereof on a movable articulation member common to said arms, the corresponding articulation axes coinciding or being parallel, a second end of said arms being articulated about articulation axes parallel to said articulation axes of said first ends, respectively on the frame and on a part integral with said second support part, the lengths of said two arms between their respective articulation axes being equal, the actuating device further comprising a mechanical coupling member between said common articulation member and said supporting means for the body.

6. A device according to claim 5 wherein said coupling member comprises a rod which is mechanically coupled, on the one hand with the articulation member of said arms, and on the other hand with said supporting means, at least one of these mechanical couplings being realized by sliding means for the rod in a direction parallel to the plane of symmetry of said articulation axes.

7. A device according to any one of claims 4 to 6 for magnetizing disks fitted with a rotation shaft, wherein the supporting device comprises a hollow element into which a portion of the disk shaft can be inserted.

* * * * *